US006507327B1

(12) United States Patent
Atherton et al.

(10) Patent No.: US 6,507,327 B1
(45) Date of Patent: Jan. 14, 2003

(54) CONTINUOUS ILLUMINATION PLASMA DISPLAY PANEL

(75) Inventors: James Harold Atherton, Ringoes, NJ (US); Michael Gillis Kane, Somerset, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/490,012

(22) Filed: Jan. 21, 2000

Related U.S. Application Data

(60) Provisional application No. 60/116,730, filed on Jan. 22, 1999.

(51) Int. Cl.[7] ..... G09G 3/28

(52) U.S. Cl. ..... 345/68; 345/60; 345/66; 345/67; 345/204; 315/169.1; 315/169.2; 315/169.4

(58) Field of Search ..... 345/60–63, 66–68, 345/204, 214, 690–692; 315/169.1, 169.2, 169.4

(56) References Cited

U.S. PATENT DOCUMENTS

| | | | | |
|---|---|---|---|---|
| 4,613,854 A | | 9/1986 | Holz et al. | |
| 5,049,865 A | | 9/1991 | Nakamura et al. | |
| 5,075,597 A | | 12/1991 | Salsvin et al. | |
| 5,436,634 A | | 7/1995 | Kanazawa | 345/67 |
| 5,583,527 A | | 12/1996 | Fujisaki et al. | |
| 5,724,054 A | * | 3/1998 | Shinoda | 345/60 |
| 5,841,413 A | * | 11/1998 | Zhu et al. | 345/63 |
| 5,952,986 A | * | 9/1999 | Nguyen et al. | 345/68 |
| 6,097,357 A | * | 8/2000 | Shinoda et al. | 345/63 |
| 6,097,368 A | * | 8/2000 | Zhu et al. | 345/153 |
| 6,292,160 B1 | * | 9/2001 | Mikoshiba et al. | 345/60 |

FOREIGN PATENT DOCUMENTS

EP 0 833 299 A1 4/1998

OTHER PUBLICATIONS

Ishii et al, "43.2 Driving of PDPs . . . Using a Grouped Address–While–Display Scheme", SID 01 Digest, pp. 1134–1137.*

Kang et al, "43.1: A New 42–In. AC PDP Using MAoD II Driving Scheme", SID 01 Digest, pp. 1130–1133.*

Rik Myslewski, "It's A Gas", MacUser Online Exclusive, Mar. 22, 1996, pp. 1–3.

T. Nakamura et al., "Drive for 40–in.–Diagonal Full–Color ac Plasma Display", SID 95 Digest, pp. 807–810.

* cited by examiner

*Primary Examiner*—Richard Hjerpe
*Assistant Examiner*—Henry N. Tran
(74) *Attorney, Agent, or Firm*—W. J. Burke

(57) ABSTRACT

A three electrode plasma display panel (PDP) operates in concurrent sustain and addressing periods, rather than separating the sustain and addressing periods. Because of this concurrent operation, a PDP with a brighter display is produced. Crosstalk between sustain electrodes and the column electrodes of non-selected rows is mitigated by implementing column voltages such that there is no difference in crosstalk brightness levels in non-addressed pixels in the on state compared to non-addressed pixels in the off state. This is accomplished by choosing column voltages that are approximately symmetric about one-half of the sustain voltage.

23 Claims, 4 Drawing Sheets

CONTINUOUS ILLUMINATION PLASMA DISPLAY PANEL

This application claims benefit of the filing date of Provisional Application No. 60/116,730 filed Jan. 22, 1999.

FIELD OF THE INVENTION

The present invention relates generally to a plasma display panel (PDP) and a method of operating the display panel. More specifically, the present invention is related to apparatus and a method of concurrently addressing and sustaining the display panel.

BACKGROUND OF THE INVENTION

Plasma Display Panels (PDPs) offer promising technology for implementing large, flat video screens. A typical PDP may be formed by enclosing a gas, for example, a mixture of helium and neon between a transparent front panel and a back panel. Electrodes may be routed on the front panel and on the back panel and phosphors may be printed on either the front panel or the back panel. The electrodes are used to ionize the gas, forming a plasma which emits ultraviolet radiation. The ultraviolet radiation, in turn, causes the phosphors to emit visible light. Color displays are made by forming adjacent columns having red, green and blue phosphors, respectively.

A common type of PDP is the three-electrode pulsed Alternating Current (AC) device. In this configuration, each display row includes two parallel row electrodes, for example, on the inside surface of the back panel and each column includes one column electrode, for example, on the inside surface of the front panel. The row electrodes on the back panel may be covered with a dielectric layer so that no direct current (DC) flows between the electrodes when the plasma is formed. The electrodes on the front panel may also be covered with a dielectric layer.

Briefly, an AC plasma display operates in two phases or states, the writing phase (writing state) and the illumination phase (sustain state). In the writing phase of a given sub-field, data values are written into each pixel position of the display device one row at a time. The rows are selected one at a time by successively applying a scan potential to each row. At the same time, voltages are applied to the column electrodes to establish a relatively high potential between the column electrodes and the selected row electrode for pixels that are to be illuminated during the sustain state of the sub-field interval, and to establish a relatively low potential between the column electrodes and the selected row electrode for pixels that are not to be illuminated during the sustain state. The relatively high potential causes an electric charge to be deposited between the front and back panels, on the inside walls of the dielectric layers, at the respective pixel position. This electric charge is commonly known as a wall charge.

Thus, a pixel which will be bright has a wall charge written into it, and thus receives "ON" data. A pixel which will be dark does not have a wall charge written into it, and thus receives "OFF" data. In some implementations, the writing phase includes a preliminary erase step in which wall charges from the previous frame of data are erased.

After the wall charge has been written for each row of the display, the sustain state of the sub-field begins. During the sustain state a predetermined potential is applied in pulses between the two parallel row electrodes across the entire display. If a pixel position has a wall charge ("ON" data), the predetermined potential starts the plasma at that pixel position. If the pixel position does not have a wall charge ("OFF" data), the plasma does not start.

Each pixel of a plasma display panel is either turned on or turned off. Gray scale and different colors are implemented by dividing the field interval into multiple sub-fields, each comprising both an addressing phase and an illumination phase. The illumination phases of successive sub-fields have different lengths so that a given pixel illumination may be obtained by illuminating the pixel position only during some of the sub-fields. One method uses eight binary-weighted sub fields, such that the second sub-field being illuminated for twice as long as the first sub-field, the third sub-field being illuminated for twice as long as the second sub-field and so on. Using this method, monochrome images having 8-bit gray scale resolution and color images having 24-bits of color resolution may be displayed on the panel.

This high color resolution comes at a cost. In conventional PDPs, illumination is prohibited in the writing phase while rows are being written. Accordingly, if eight sub-fields are used, the display must be dark for eight addressing intervals during each frame interval. If illumination is attempted while rows are being written, crosstalk may occur as data voltages on the column electrodes may interfere with the discharge in unselected rows. Thus, adding sub-fields increases the gray scale and color resolution of the reproduced image but reduces its brightness. In some conventional display devices, about 50% of each frame time is taken up by the writing phases of the various sub-fields. Thus, a significant improvement to the art would be provided by a method for concurrently writing and illuminating a PDP.

SUMMARY OF THE INVENTION

The present invention provides a method of concurrently addressing and sustaining rows and columns in a plasma display panel (PDP) while not causing artifacts in non-addressed rows. Each PDP comprises a plurality of row electrode pairs, a plurality of column electrodes, and a plurality of pixels. A pixel is formed at the intersection of each row electrode pair and each column electrode. The method comprises the steps of sustaining the illumination of all pixels except those formed by the one row that is selected to receive new data. Pixels are addressed for illumination by providing data signals to the column electrodes and sustain signals to the display rows that are not being addressed, such that the data signals do not cause artifacts in the non-addressed rows.

According to one aspect of the invention, the voltage values for the binary one and binary zero data signals are selected to be symmetrical about one-half of the sustain voltage.

According to another aspect of the invention, the voltage values for the binary one and binary zero data signals are dynamically changed to temporally compensate for vertical crosstalk.

According to another aspect of the invention, the pixel values in the column are modified to compensate for vertical crosstalk in the column.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
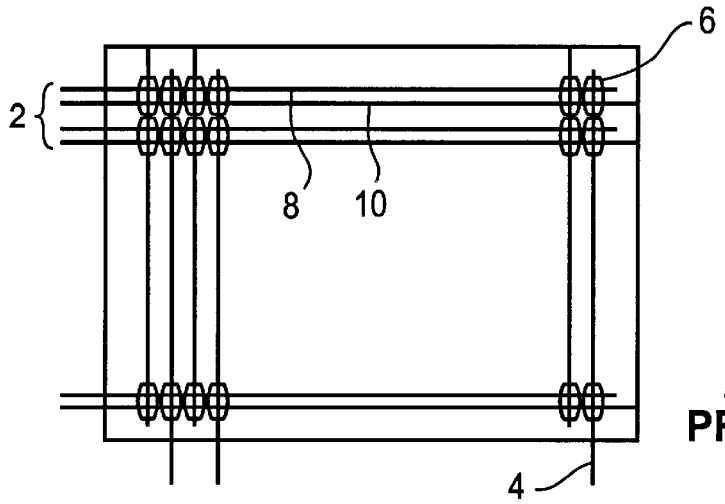
FIG. 1 PRIOR ART
FIG. 1 (prior art) is a plan view depicting the configuration of row and column electrodes of a conventional three-electrode plasma display panel (PDP)

FIG. 1 is a plan view depicting the configuration of row and column electrodes of a conventional three-electrode plasma display panel (PDP). The PDP depicted in FIG. 1 comprises a plurality of rows and columns forming an array. Each row comprises a pair of row electrodes 2 and each column comprises a single column electrode 4. A separate picture element (pixel) 6 is formed at the intersection of each column electrode 4 and each pair of row electrodes 2. Each row electrode pair 2, comprises a first row electrode 8 and a second row electrode 10. Thus, a conventional three-electrode PDP comprises an array of parallel row electrode pairs and orthogonal column electrodes forming pixels at their intersecting points.

As described above, the operation of a PDP is divided into two phases, ran address phase and a sustain (illumination) phase. The address phase comprises a preliminary erase step and a write phase. The erase step removes residual wall charges (wall charges are mobile charges that are deposited on the interior dielectric walls of a pixel while a voltage is applied to a plasma). During the address phase, select signals are provided to each pixel position of the display device one row at a time. The rows are selected one at a time by successively applying a signal to each row. At the same time, binary one and binary zero data signals are provided to the column electrodes. The binary one signal establishes a relatively high potential between the column electrodes and the selected row electrodes for pixels that are to be illuminated during the sustain phase, and the binary zero signal establishes a relatively low potential between the column electrodes and the selected row electrode for pixels that are not to be illuminated during the sustain phase. The relatively high potential is sufficient to cause a wall charge to be deposited on the interior dielectric walls of a pixel, at the respective pixel position, while the relatively low potential is not sufficient to establish a wall charge. The voltage of the sustain signals is selected to be sufficient to cause plasma discharge only for those pixels that have a wall charge.

Figure 2:
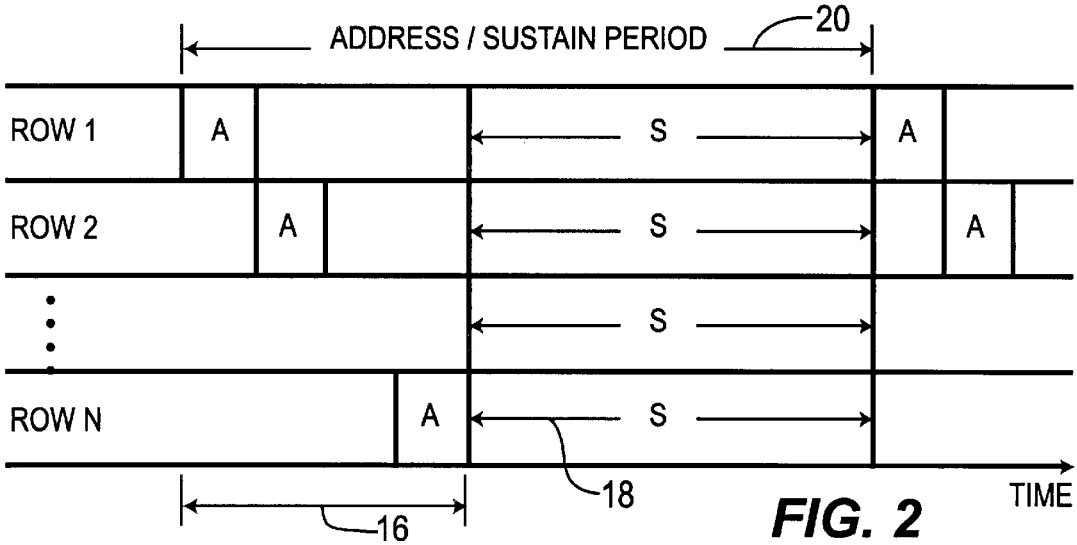
FIG. 2 PRIOR ART
FIG. 2 (prior art) is a timing diagram depicting the relationship between address periods and sustain (illumination) periods for a conventional PDP.

FIG. 2 is a timing diagram depicting the relationship between address periods and sustain (illumination) periods for one sub-field of a conventional PDP display device. In conventional PDP devices, illumination is prohibited during the address phase. The primary reason for this is that voltages applied to the columns to write wall charges into the addressed row will cause vertical crosstalk in the non-addressed rows. The binary one data voltage on the column electrode may cause that electrode to act as a secondary cathode producing additional brightness from all "on" pixels in the column, compared to the pixels of a column electrode having a binary zero data voltage. Thus, in FIG. 2, the address phase for each row occurs during the address period 16 and the sustain phase occurs during the separate sustain period 18. The prohibition of concurrent illumination and addressing may been seen in FIG. 2 in that sustain period 18 does not begin until all rows have been addressed. Because the brightness of the PDP is directly proportional to the total length of all of the sub-field sustain periods in each frame interval, the larger the proportion of the address/sustain period 20 that is dedicated to the sustain phase, the brighter the display.

Figure 3:
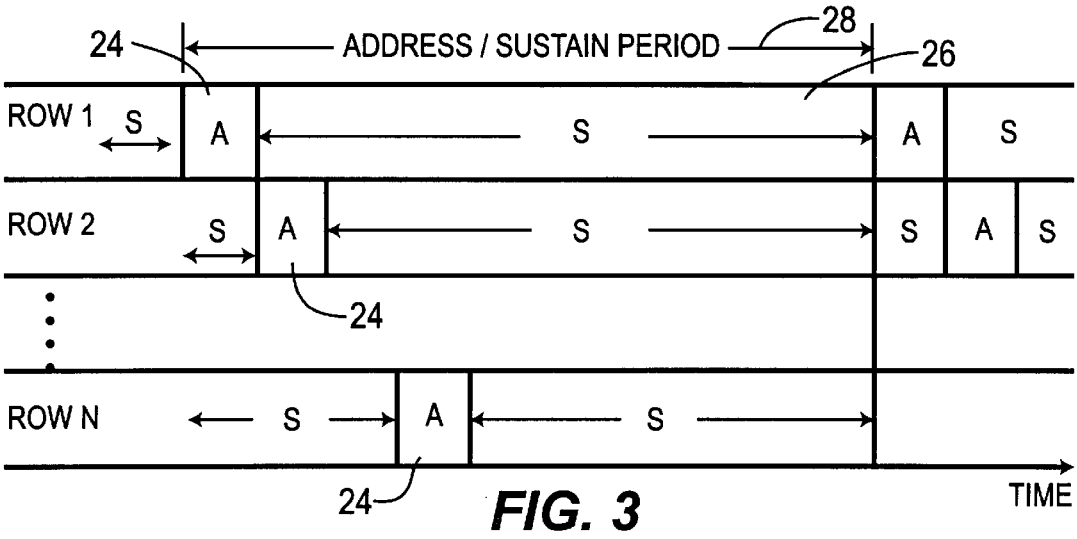
FIG. 3 is a timing diagram illustrating an exemplary relationship between address periods and sustain (illumination) periods for a PDP in accordance with the invention.

FIG. 3 is a timing diagram illustrating an exemplary relationship between address periods and sustain (illumination) periods for one sub-field of a PDP in accordance with the present invention. In an exemplary embodiment of the invention, each row of the PDP array operates in the sustain (illumination) phase continuously, except for a short period of time when old data is erased and new data is written into that row. In row 1 of FIG. 3, the address phase occurs during the address period 24, and the sustain phase occurs during the sustain period 26. Note that in FIG. 3, each row is in the sustain phase for the entire address/sustain period 28 except for the address period 24. Address period 24 in one row, may overlap with sustain periods in other rows. Row 2 is in the address phase during address period 24 at the same time row 1 and rows 3 through N are in the sustain phase.

For example, to display a VGA image, a PDP displays 480 rows, each row having 640 pixels, in 525 line times during 1/60 of a second. The 1/60 of a second frame interval is divided into eight sub-frames, each including a fixed length addressing period and a binary weighted sustain period. If, as in conventional display devices, the sum of the address periods for all of the display rows is equal to one-half of the combined address/sustain period, then the total address period 24 is equal to approximately 1.64 milliseconds. If the addressing is done on a line-by-line basis, then the total addressing time for each line is approximately 2.17 microseconds. Consequently, the sustain period for each row is approximately equal to the address/sustain period for the entire frame minus 2.17 microseconds. This results in the sustain phase for each row being maintained for about 99.9% of the address/sustain period 28. This is a significant increase over the typical 50% allocation found in conventional PDP operating schemes. Therefore, an advantage of the invention is the provision of a display that is brighter than PDPs utilizing conventional addressing techniques.

Because the display is brighter, a relatively bright image is displayed even if the number of sub-fields is increased. This allows greater gray-scale and color resolution, better compensation for moving contour artifacts or both compared to a display device in which all pixels are turned off during the addressing periods. The total addressing period for all subfields is desirably less than one horizontal line time so that each line may be fully addressed in one frame period.

Figure 4:
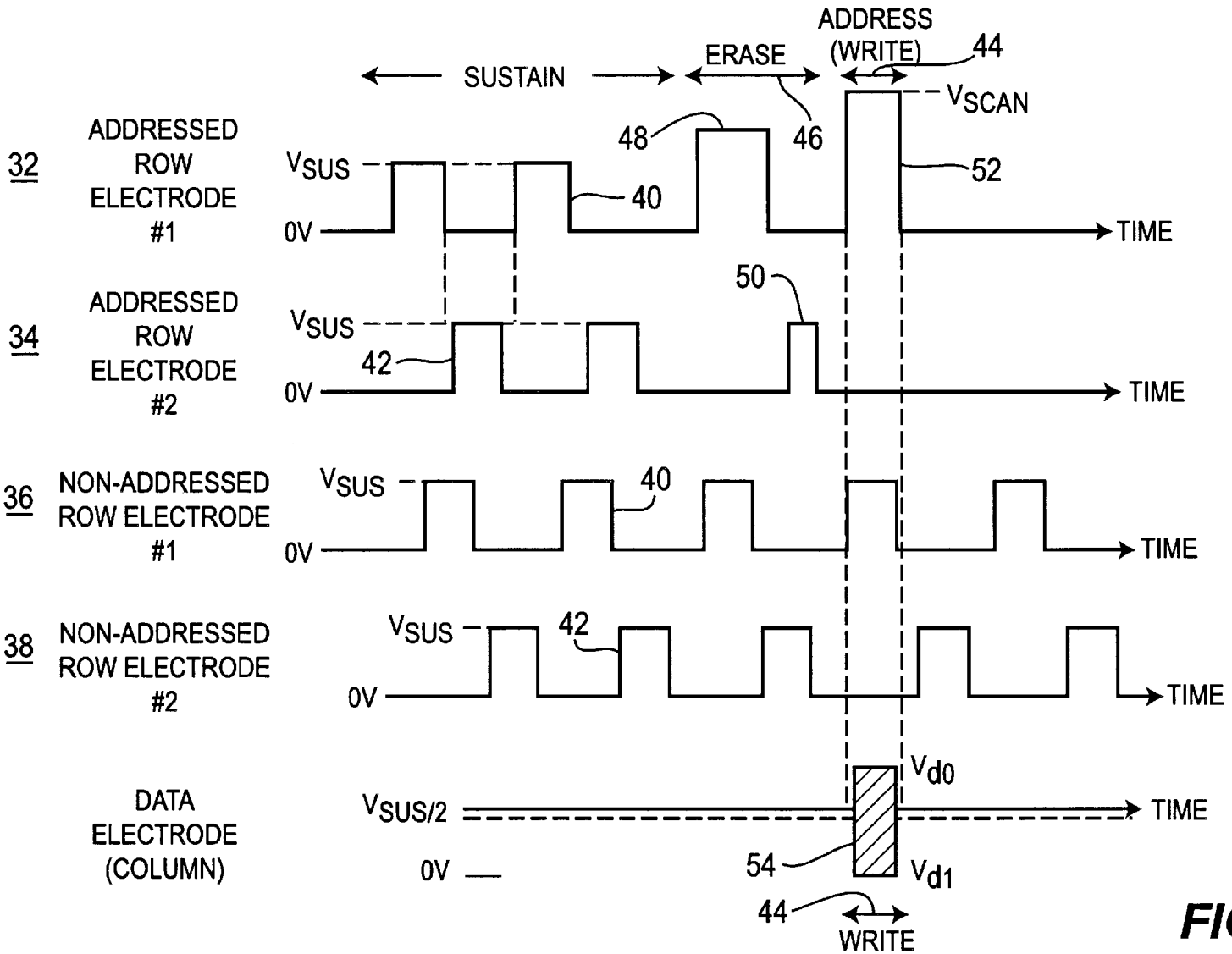
FIG. 4 is a timing diagram illustrating exemplary row electrode and column electrode signals in accordance with the invention.

FIG. 4 is a timing diagram illustrating exemplary row electrode and column electrode signals in accordance with the invention. Pulse sequences 32 and 34 depict exemplary sequences of pulses for a first row electrode and a second row electrode, respectively, during portions of the sustain phase and the address phase. Pulse sequences 36 and 38 depict exemplary sequences of pulses for a first row electrode and a second row electrode, respectively, during a portion of the sustain phase. The concurrent occurrence of pulse sequences 36 and 38 with pulse sequences 32 and 34, allows the pixels receiving pulse sequences 36 and 38 to be illuminated while the pixels receiving pulse sequences 32 and 34 are being selected. An exemplary sustaining signal, applied to both row electrodes of a row electrode pair, comprises out of phase (alternating) pulse sequences 40 and 42, applied to the first row electrode and the second row electrode, respectively. The amplitude of the sustaining signal, in volts, $V_{sus}$, is sufficient to sustain a plasma in a pixel in that row in the presence of wall charges. However, the amplitude, $V_{sus}$, of the sustaining signal is not sufficient to start a plasma if wall charges are not present. Thus, the sustaining of plasma during the sustain period depends on whether wall charges were written into the pixel during the addressing period such that the wall charges are present at the beginning of the sustain period.

During the address phase, the write phase 44 is preceded by an erase phase 46. During the erase phase 46, exemplary erase pulses 48 and 50 are provided to row electrode 1 and row electrode 2, respectively, to erase residual wall charges on pixels within that row. Upon completion of the erase phase 46, the write phase 44 begins. During the write phase 44, one of the row electrodes of a row electrode pair is held at a reference voltage, $V_{ref}$, and the other row electrode of the row electrode pair is pulsed with a scan signal, having an amplitude, in volts, equal to $V_{scan}$. In FIG. 4, an exemplary embodiment of the write phase is illustrated by scan signal 52 being applied to row electrode 1 and a reference signal, equal to zero volts, being applied to row electrode 2. Also, during the write phase 44, data signals are provided to the column electrodes. Binary data signals, with voltage amplitudes depicted as $V_{d0}$ and $V_{d1}$in FIG. 4, are used to create wall charges in selected pixels of the display column. In the exemplary embodiment shown in FIG. 4, the data values are written during a pulse of the sustain signal 36 and between pulses of the sustain signal 38. It is contemplated, however, that the data values may be applied to the pixels in the column without regard to the state of the sustain pulses.

In an exemplary embodiment of the invention, $V_{d1}$is the amplitude of the data signal provided to create a wall charge, and $V_{d0}$is the amplitude of the data signal provided if a wall charge is not to be created. Thus, as depicted in FIG. 4, during the write phase 44, the column electrode is provided a data signal equal to either $V_{d0}$ or $V_{d1}$, the first row electrode is provided a scan signal equal to $V_{scan}$, and the second row electrode is provided a reference signal equal to zero volts. In this exemplary embodiment, a pixel with a data signal equal to $V_{d0}$ has a total voltage potential across its electrodes equal to $V_{scan}-V_{d0}$ volts while a pixel with a data signal equal to $V_{d1}$ has a total voltage potential across its electrodes equal to $V_{scan}-V_{d1}$ volts.

In an exemplary embodiment of the invention, $V_{scan}-V_{d1}$ is sufficient to create significant wall charges on opposing row electrodes, while $V_{scan}-V_{d0}$ is not sufficient to create significant wall charges. The difference between the data voltages ($V_{d0}-V_{d1}$) should be large enough to compensate for possible non-uniformities throughout the PDP, and variations in manufacturing. In one exemplary embodiment, $V_{sus}$=170 volts, $V_{d0}$=115 volts, $V_{d1}$=55 volts, and $V_{scan}$=285 volts. These values result in $V_{scan}-V_{d1}$=230 volts, which is typically sufficient to create significant wall charges, and $V_{scan}-V_{d0}$=170 volts, which is typically not sufficient to create significant wall charges.

To prevent crosstalk while sustain signals are applied to non-addressed rows, exemplary values of $V_{d0}$ and $V_{d1}$ are chosen such that there is no perceptible difference in brightness level in non-addressed pixels with wall charges when the data signal equals $V_{d0}$ compared to when the data signal equals $V_{d1}$. This condition is illustrated in FIG. 4 by signal 54. Signal 54 depicts $V_{d0}$ and $V_{d1}$ being approximately symmetric about $V_{sus}/2$. Mathematically, this condition is expressed by the following formula:

$$\frac{V_{sus}}{2} - V_{d1} \approx V_{d0} - \frac{V_{sus}}{2}.$$

In the operation of a plasma display according to the present invention, two voltage differences appear at each pixel position in an image column while data is being written into one pixel position in the column. Assuming that the two sustain electrodes alternate between $V_{sus}$ and 0 volts, when a binary one is being written into the pixel position, these voltage differences are and $V_{sus}-V_{d1}$ and $V_{d1}$. When the data voltages are symmetric about $V_{sus}/2$, the difference between $V_{sus}$ and $V_{d1}$ may be expressed as $V_{diff1}=V_{sus}-(V_{sus}/2V_s)$, where $V_s$ is the difference between $V_{sus}/2$ and $V_{d1}$. This equation simplifies to $V_{diff1}=V_{sus}/2+V_s$. The voltage $V_{d1}$ may be expressed as $V_{sus}/2-V_s$. Similarly, when a binary zero is being written into the column, the two voltage differences are $V_{sus}-V_{d0}$ and $V_{d0}$. These voltages differences translate to $V_{sus}/2-V_s$ and $V_{sus}/2+V_s$. Accordingly, whether a binary zero or a binary 1 is being written into the pixel position, the same pair of voltage differences appears at each of the non-addressed pixel positions in the column.

Because, however, positive ions behave differently than electrons, it may be desirable to choose $V_{d0}$ and $V_{d1}$ to be not exactly symmetric about $V_{sus}/2$. The amount of this offset and its polarity may depend on many factors, for example, the pixel structure of the particular plasma display device and the relative potentials of $V_{sus}$, $V_{d0}$ and $V_{d1}$. The required offset for a particular plasma display panel may be determined, for example, by repeatedly storing binary one values into pixels on one line of the image while repeatedly storing binary zero values into an adjacent group of pixels on the one line and adjusting $V_{sus}$ until differences in the pixels on the non-addressed lines are minimized.

In an alternate embodiment, it is assumed that the values of $V_{d0}$ and $V_{d1}$ produce different brightness levels on the pixels that are illuminated but not addressed. A minimum brightness value would be generated if the data voltage were equal to $V_{sus}/2$. The greater the difference between $V_{d0}$ and $V_{sus}/2$ on the one hand and $V_{d1}$ and $V_{sus}/2$ on the other hand, the greater the brightness of the crosstalk artifacts in the image column. In the first alternative embodiment of the invention, the values of $V_{d1}$ and $V_{d0}$ are modified dynamically based on image content. As a first step in this process, the numbers of binary one pixels and binary zero pixels in a given column are determined. Next, values for $V_{d0}$ and $V_{d1}$ are determined which will provide a predetermined net change in column illumination over the sub-field interval. These dynamically modified values of $V_{d1}$ and $V_{d0}$ may be applied during the address period of one or more rows or during a correction period when rows are being sustained but not addressed. If this is done for all columns in the display then all columns will have the same predetermined level of illumination resulting from vertical crosstalk. The voltages should not be changed, however, to the extent that the difference between one of the data voltages and either the sustain voltage or the reference voltage is sufficient to store a wall charge into a pixel cell.

In second alternative embodiment, the number of binary ones and binary zeros in the column are determined and then the binary values of the pixels in that column are adjusted to compensate for the vertical crosstalk that occurs in one sub-frame interval. Using this method, the total illumination produced by the column of pixels in the sub-field interval may be matched to the desired illumination of the pixels in the absence of vertical cross talk.

Figure 5:
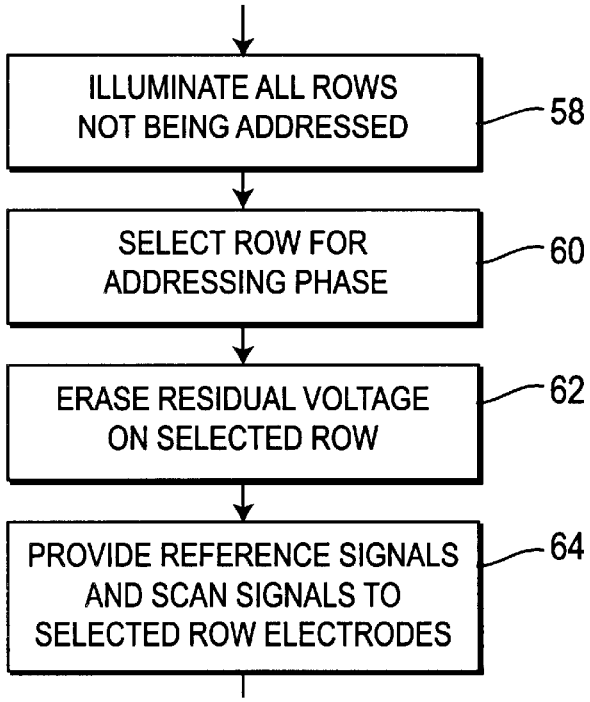
FIG. 5 is a flow diagram illustrating an exemplary process for concurrently sustaining and addressing a PDP.

FIG. 5 is a flow diagram illustrating an exemplary process for concurrently sustaining and addressing a PDP using data voltages which are symmetric about the sustain voltage. In step 58, all pixels in a PDP are in the sustain phase (illuminated) except for pixels in a row which are in the address phase (if any). In step 60, a row is selected for the address phase. Step 60 can follow a sustain phase, an address phase for a different row, or a correction phase. Residual wall charges, on pixels in the row selected in step 60, are erased during the erase phase of the address phase in step 62. At step 64, the reference and scan signals are applied to the selected row to store the data values into the pixels of the selected row. These data values cause wall charges to be stored in those pixels. Wall charges are created, in part, by providing a $V_{d1}$ data signal on the column electrode of the selected pixel, and the appropriate scan and reference signals on the row electrode pair of the selected pixel, such that the voltage potential developed between the column electrode and the scan row electrode is sufficient to create a significant wall charge. Steps 60 through 64 may be repeated as necessary while all rows not selected for the address phase are simultaneously being illuminated. As described above, the difference between the scan voltage $V_{scan}$ and the data voltage $V_{d1}$ is sufficient to create a wall charge while the difference between $V_{scan}$ and $V_{d0}$ is not sufficient to create a wall charge.

Figure 6A:
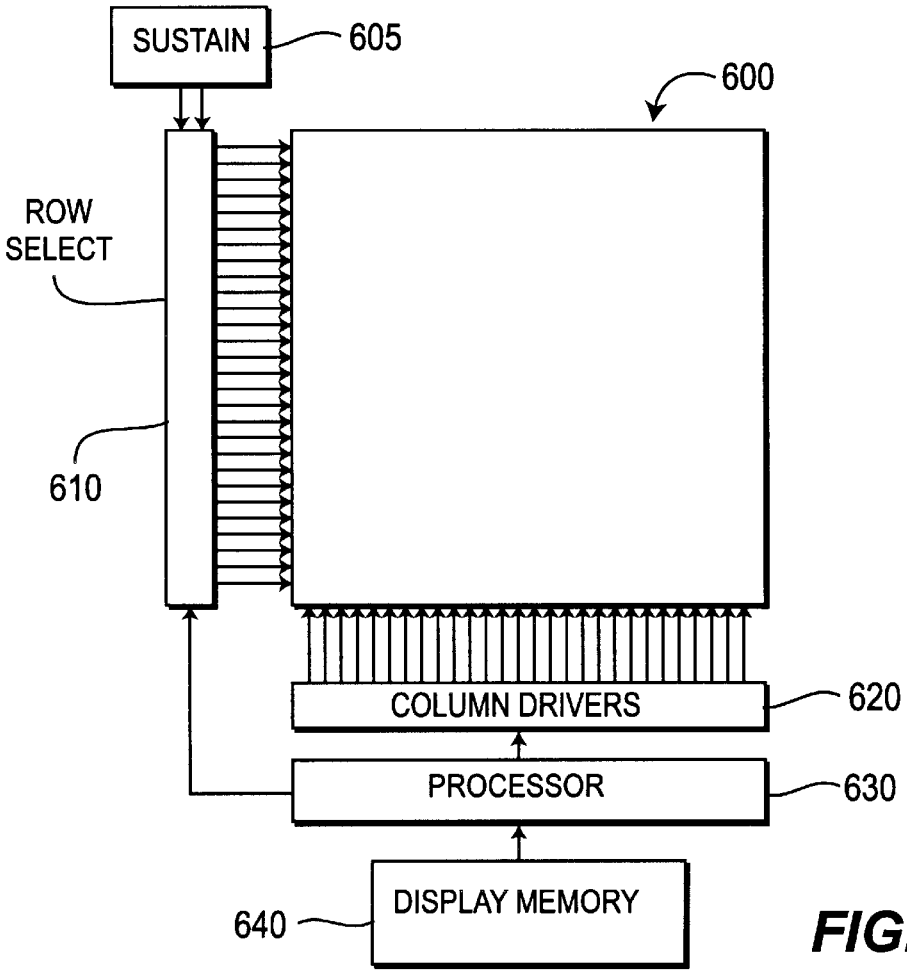
FIG. 6A is a block diagram of an exemplary PDP display apparatus which includes an embodiment of the present invention.

FIG. 6A is a block diagram of an exemplary PDP display panel and associated circuitry in accordance with the present invention. The exemplary system includes a PDP display panel 600, a sustain signal generator 605, a row select circuit 610, column drivers 620, a processor 630 and an image memory 640. The processor 630 controls the column drivers 620 and row select circuit 610 to sequentially write successive sub-frames of data to the display panel 600 while concurrently applying the sustain signals to the non-selected rows in order to produce gray-scale images. In addition, for the two alternative embodiments of the invention described above, processor 630 analyzes the number of ones and zeros being written into each column of the display panel 600 during a frame interval and adjusts either the binary values of the pixel data in the memory 640, the timing of data write operations or the amplitude of $V_{d0}$ and $V_{d1}$ in order to equalize the vertical crosstalk over the entire image.

Figure 6B:
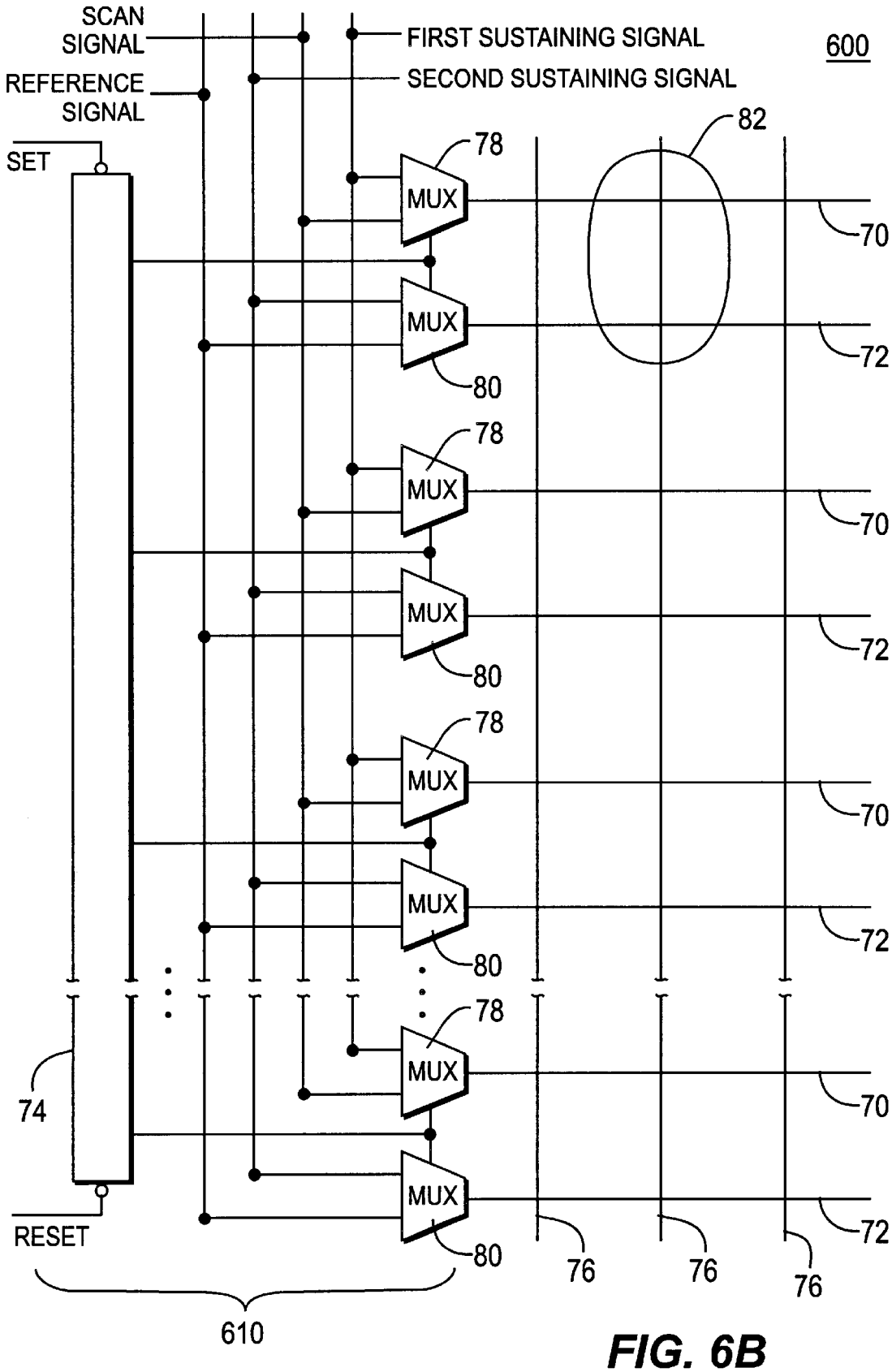
FIG. 6B is a block diagram of apparatus for selecting row electrodes during the address phase of the PDP display device shown in FIG. 6A.

FIG. 6B is a block diagram of an row select circuit 610 suitable for use in the PDP display device shown in FIG. 6A. The PDP display 600 comprises a plurality of first row electrodes 70, a plurality of second row electrodes 72 and a plurality of column electrodes 76. The row select circuit 610 includes a shift register 74, a plurality of first multiplexers 78, and a plurality of second multiplexers 80. A monochromatic pixel is formed at the intersection of each row electrode pair 70 and 72 and each column electrode 76. Thus the PDP display 600 comprises several pixels, although only a single representative pixel 82 is specifically illustrated. During the address phase, shift register 74 provides control signals to multiplexers 78 and 80 such that each row electrode pair is selected for the address phase one at a time. During successive address phases, a control signal representing a logic one (or zero) progresses through the shift register. Also, a set/reset mechanism within shift register 74 provides either all logic ones or all logic zeros to the multiplexer pairs. The set/reset feature is provided so that the shift register 74 either set (reset) when all rows 70 and 72 are in the sustain phase.

When a multiplexer pair 78 and 80 is selected, by the control signal provided by the shift register 74, for the address phase, the reference signal and the scan signal are provided to the selected row electrode pair 70 and 72 by the multiplexer pair 78 and 80. When a multiplexer pair 78 and 80 is not selected for the address phase, the first and second sustaining signals are provided to the selected row electrode pair 70 and 72 by the multiplexer pair. As set forth above, the sustain signals are pulse signals which switch between $V_{sus}$ and a reference potential and have a relative phase difference of approximately 180°.

Although illustrated and described above with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. method of addressing a plasma display panel having a plurality of row electrode pairs, each row electrode pair comprising a first row electrode and second row electrode; a plurality of column electrodes; and a plurality of pixels, each pixel comprising one of the plurality of row electrode pairs and one of the plurality of column electrodes; the method comprising the steps of:

(a) selecting a plurality of pixels by selecting one row electrode pair of the plurality of row electrode pairs by providing a scan signal and a reference signal to respective row electrodes of the one row electrode pair;

(b) providing one of a first data voltage and a second data voltage on each column electrode of the plurality of column electrodes to store data values into the plurality of selected pixels; and (c) providing respective first and second sustain signals, having a sustain signal amplitude, to respective row electrodes of each row electrode pair of the plurality of row electrode pairs which is not selected, wherein the sustain signal amplitude and the first and second data voltages are selected to provide approximately equal amounts of crosstalk illumination on the pixels of the display.

2. A method according to claim 1, wherein the first data voltage, the second data voltage, and the sustain signal amplitude are related by a formula:

$$\frac{V_{sus}}{2} - V_{d1} \approx V_{d0} - \frac{V_{sus}}{2}, \text{ wherein}$$

$V_{sus}$ is the sustain signal amplitude, $V_{d0}$ is the first data voltage; and $V_{d1}$ is the second data voltage.

3. A method according to claim 2, wherein the reference voltage is zero volts, the scan signal has a peak amplitude of 285 volts, $V_{sus}$ is 170 volts, $V_{d0}$ is 115 volts and $V_{d1}$ is 55 volts.

4. A method according to claim 1, wherein the display device displays multi-bit pixel values having varying gray scale by displaying each bit of the multi-bit pixel value in a respectively different sub-field of an image frame, and the method further includes the steps of:

analyzing the multi-bit pixel values to be displayed in a column of the display panel to determine an amount of crosstalk illumination applied to each pixel in the column; and modifying each multi-bit pixel value in the column to compensate for the determined amount of crosstalk illumination.

5. A method according to claim 1, further including the steps of:

analyzing the data voltages to be used for each selected row of one column of the plurality of columns of the display panel during one frame interval to determine an amount of crosstalk illumination provided to pixels corresponding to rows which are not selected as all of the rows in the display panel are selected; and operating the first and second data voltages to provide a target amount of crosstalk illumination to each pixel in the column during the one frame interval.

6. A method according to claim 5, wherein the display device includes a sustain phase where the first and second sustain signals are applied to all pairs of row electrodes in the display panel and no pair of row electrodes is selected, and the step of operating the first and second data voltages includes the step of operating the first and second data voltages during the sustain phase on the one column to provide the target amount of crosstalk illumination to each pixel in the column.

7. A method according to claim 5, wherein the step of operating the first and second display voltages includes the step of adjusting the first and second display voltages in amplitude to produce the target amount of crosstalk illumination in each pixel of the column.

8. display apparatus having a plurality of row electrode pairs, each row electrode pair comprising a first row electrode and second row electrode; a plurality of column electrodes; and a plurality of pixels, each pixel comprising one of the plurality of row electrode pairs and one of the plurality of column electrodes; the apparatus comprising:

means for selecting a plurality of pixels by selecting one row electrode pair of the plurality of row electrode pairs by providing a scan signal and a reference signal to respective row electrodes of the one row electrode pair;

means for providing one of a first data voltage and a second data voltage on each column electrode of the plurality of column electrodes to store data values into the plurality of selected pixels; and means for providing respective first and second sustain signals, having a sustain signal amplitude, to respective row electrodes of each row electrode pair of the plurality of row electrode pairs which is not selected, wherein the first and second is data voltages and the sustain signal amplitude are selected to provide approximately equal amounts of crosstalk illumination on the pixels of the display.

9. Apparatus according to claim 8, wherein the first data voltage, the second data voltage, and the sustain signal amplitude are related by a formula:

$$\frac{V_{sus}}{2} - V_{d1} \approx V_{d0} - \frac{V_{sus}}{2}, \text{ wherein}$$

$V_{sus}$ is the sustain signal amplitude, $V_{d0}$ is the first data voltage; and $V_{d1}$ is the second data voltage.

10. Apparatus according to claim 9, wherein the reference voltage is zero volts, the scan signal has a peak amplitude of 285 volts, $V_{sus}$ is 170 volts, $V_{d0}$ is 115 volts and $V_{d1}$ is 55 volts.

11. Apparatus according to claim 8, wherein the display device displays multi-bit pixel values having varying gray scale by displaying each bit of the multi-bit pixel value in a respectively different sub-field of an image frame, and the apparatus further includes:

means for analyzing the multi-bit pixel values to be displayed in a column of the display panel to determine an amount of crosstalk illumination applied to each pixel in the column; and means for modifying each multi-bit pixel value in the column to compensate for the determined amount of crosstalk illumination.

12. Apparatus according to claim 8, further including:

means for analyzing the data voltages to be used for each selected row of one column of the plurality of columns of the display panel during one frame interval to determine an amount of crosstalk illumination provided to pixels corresponding to rows which are not selected as all of the rows in the display panel are selected; and means operating the first and second data voltages to provide a target amount of crosstalk illumination to each pixel in the column during the one frame interval.

13. Apparatus according to claim 12, wherein the display device includes a sustain phase where the first and second sustain signals are applied to all pairs of row electrodes in the display panel and no pair of row electrodes is selected, and the means for operating the first and second data voltages includes means for operating the first and second data voltages during the sustain phase on the one column to provide the target amount of crosstalk illumination to each pixel in the column.

14. Apparatus according to claim 12, wherein the means for operating the first and second display voltages includes means for adjusting the first and second display voltages in amplitude to produce the target amount of crosstalk illumination in each pixel of the column.

15. A plasma display apparatus having a plurality of row electrode pairs, each row electrode pair comprising a first row electrode and second row electrode; a plurality of column electrodes; and a plurality of pixels, each pixel comprising one of the plurality of row electrode pairs and one of the plurality of column electrodes; the apparatus comprising:

a sustain signal generator which provides respective first and second sustain signals, having a sustain signal amplitude;

a row select circuit which selects one row electrode pair of the plurality of row electrode pairs and provides a scan signal and a reference signal to respective row electrodes of the one row electrode pair and which provides the first and second sustain signals to respective row electrodes of each row electrode pair of the plurality of row electrode pairs which is not selected, said first and second sustain signals being provided continuously to said row electrode pairs which are not selected while the one row electrode pair is selected; and a column driver circuit which provides one of a first data voltage and a second data voltage on each column electrode of the plurality of column electrodes to store data values into the plurality of selected pixels.

16. Apparatus according to claim 15, wherein the first and second data voltages and the sustain signal amplitude are selected to provide approximately equal amounts of crosstalk illumination on the pixels of the display.

17. Apparatus according to claim 16, wherein the first data voltage, the second data voltage, and the sustain signal amplitude are related by a formula:

$$\frac{V_{sus}}{2} - V_{d1} \approx V_{d0} - \frac{V_{sus}}{2}, \text{ wherein}$$

$V_{sus}$ is the sustain signal amplitude, $V_{d0}$ is the first data voltage; and $V_{d1}$ is the second data voltage.

18. Apparatus according to claim 17, wherein the reference voltage is zero volts, the scan signal has a peak amplitude of 285 volts, $V_{sus}$ is 170 volts, $V_{d0}$ is 115 volts and $V_{d1}$ is 55 volts.

19. Apparatus according to claim 15, wherein the display device displays multi-bit pixel values having varying gray scale by displaying each bit of the multi-bit pixel value in a respectively different sub-field of an image frame, and the apparatus further includes a processor that analyzes the multi-bit pixel values to be displayed in a column of the display panel to determine an amount of crosstalk illumination applied to each pixel in the column and that modifies each multi-bit pixel value in the column to compensate for the determined amount of crosstalk illumination.

20. Apparatus according to claim 15, further including a processor that analyzes the data voltages to be used for each selected row of one column of the plurality of columns of the display panel during one frame interval to determine an amount of crosstalk illumination provided to pixels corresponding to rows which are not selected as all of the rows in the display panel are selected and that operates the first and second data voltages to provide a target amount of crosstalk illumination to each pixel in the column during the one frame interval.

21. Apparatus according to claim 20, wherein the display device includes a sustain phase where the first and second sustain signals are applied to all pairs of row electrodes in the display panel and no pair of row electrodes is selected, and the processor applies the first and second data voltages during the sustain phase on the one column to provide the target amount of crosstalk illumination to each pixel in the column.

22. Apparatus according to claim 20, wherein the processor adjusts the first and second display voltages in amplitude to produce the target amount of crosstalk illumination in each pixel of the column.

23. A display apparatus comprising:

a plurality of row electrode pairs, each one of the plurality of row electrode pairs having a first row electrode and second row electrode;

a plurality of column electrodes, a plurality of pixels, each one of the plurality of pixels comprising one of the plurality of electrode pairs and one of the plurality of column electrodes;

a plurality of multiplexer pairs, each one of the plurality of multiplexer pairs having a first multiplexer and a second multiplexer, each multiplexer having a first input connector, a second input connector, a control connector, and an output connector, wherein the output connector of the first multiplexer of each of the plurality of multiplexer pairs is electrically coupled to the first row electrode of one of the plurality of row electrode pairs and the output connector of the second multiplexer of each of the plurality of multiplexer pairs is electrically coupled to the second row electrode of one of the plurality of row electrode pairs, such that each output connector is electrically coupled to only one row electrode and each row electrode is electrically coupled to only one output connector;

a shift register electrically coupled to the multiplexer control connectors for providing control signals, a first sustaining signal electrically coupled to the first input connector of every first multiplexer, a second sustaining signal electrically coupled to the first input connector of every second multiplexer, a scan signal electrically coupled to the second input connector of every first multiplexer; and a reference signal electrically coupled to the second input connector of every second multiplexer.

* * * * *